US006203510B1

(12) United States Patent
Takeuchi et al.

(10) Patent No.: US 6,203,510 B1
(45) Date of Patent: Mar. 20, 2001

(54) COMPRESSING DEVICE FOR PNEUMATIC MASSAGER

(75) Inventors: Hirosato Takeuchi; Mitsuma Matsumura, both of Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 09/118,852

(22) Filed: Jul. 20, 1998

(30) Foreign Application Priority Data

Jul. 30, 1997 (JP) ..... 9-218359
Sep. 3, 1997 (JP) ..... 9-252688
Dec. 5, 1997 (JP) ..... 9-352368

(51) Int. Cl.[7] ..... A61H 1/00
(52) U.S. Cl. ..... 601/152
(58) Field of Search ..... 601/55, 61, 148–152; 128/DIG. 20

(56) References Cited

U.S. PATENT DOCUMENTS 1,795,304 * 3/1931 Howard .
4,029,087 * 6/1977 Dye et al. .
4,402,312 * 9/1983 Villari et al. .
4,805,601 * 2/1989 Eischen .

FOREIGN PATENT DOCUMENTS 63-68164 3/1988 (JP) .

* cited by examiner

*Primary Examiner*—Danton D. DeMille
(74) *Attorney, Agent, or Firm*—Wenderoth, Lind & Ponack, L.L.P.

(57) ABSTRACT

A compressing device for a pneumatic massager includes a bag body formed of a plurality of airtight cells with sealed portions for separating the airtight cells and adapted to inflate and contract the airtight cells by supplying and discharging compressed air to and from the bag body. At least one of the airtight cells is provided with a port for supplying and discharging compressed air. The bag body is provided with a communicating path allowing communication between the at least one airtight cell and the airtight cells lacking the port.

14 Claims, 9 Drawing Sheets

COMPRESSING DEVICE FOR PNEUMATIC MASSAGER

BACKGROUND OF THE INVENTION

1. Field of the Invention

This invention relates to a compressing device for a pneumatic massager, which is provided with a plurality of airtight cells adapted to be inflated and contracted by the supply and discharge of compressed air.

2. Description of the Prior Art

A conventional compressing device for a pneumatic massager generally has a plurality of airtight cells arranged parallel so as to form a compressing bag with a sheetlike wall and permits the massager to be used by having the compressing bag wrapped fast around an arm or a leg.

In this case, the compressing bag, to which compressed air inlets and outlets and compressed air sources disposed in the airtight cells are connected via air hoses, produces a massaging action by inflating and contracting the airtight cells sequentially in the direction from the peripheral to the central side by effecting the supply and discharge of compressed air in the relevant airtight cells.

The massager of this construction, therefore, requires as many air hoses as airtight cells and, at the same time, requires distributors for supplying compressed air from a compressed air supply source such as a compressor to the plurality of airtight cells and discharging compressed air from the interior of the airtight cells. Particularly, the distributors tend to boost the cost of the massager because of their complicated structure.

Further, the conventional compressing bag, when attached to a leg or an arm, inevitably covers the joints of the leg or arm and compels the user to incur difficulty in bending the joints. As a measure to abate this difficulty, it has been proposed to form separate bags and attach the bags separately to the thigh and the lower leg. In this case, the number of sites of attachment are increased, the time spent for attachment is longer, and the number of component parts is increased, possibly causing additions to the cost of the massager itself.

A distributing valve intended to handle compressed air is expensive as mentioned above, because of its complicated structure, and poses the problem of inevitably boosting the cost of the pneumatic massager. Under the circumstances, the desirability of developing a compressing device for a pneumatic massager using inexpensive distributing valves simple in structure, or requiring no distributing valve, that produces the same effect as the conventional compressing device, has been finding recognition.

This invention has been perfected in consequence of a diligent study conducted with a view to solving the problems encountered by the conventional compressing device for the pneumatic massager as described above. It has for an object thereof the provision of a compressing device for a pneumatic massager which is capable of sequentially inflating airtight cells in a direction from a peripheral to a central portion of the body along a venous stream without using a distributing valve and, even when the user wearing this compressing device operates the massager while keeping the joints in a bent state, ensuring a satisfactory flow of compressed air in spite of the presence of bends in the communicating paths, and enabling the compressed air to be supplied sequentially from the airtight cells on the peripheral side onward and consequently causing the airtight cells to be inflated sequentially in the direction from the peripheral end of an appendage (peripheral part of the body); to the central end of the appendage at the central portion (central part of body).

SUMMARY OF THE INVENTION

To accomplish the object mentioned above, this invention provides a compressing device for a pneumatic massager, comprising a bag body formed of a plurality of airtight cells with sealed portions for separating the airtight cells and adapted to inflate and contract the airtight cells by supplying and discharging compressed air to and from the bag body, at least one of the airtight cells is provided with a port for supplying and discharging compressed air, and the bag body is provided with a communicating path allowing communication between the at least one airtight cell and the airtight cells lacking the port. In this construction, when an air hose communicating with a compressed air supply source is connected to the port provided in the airtight cell and compressed air is supplied to the airtight cell, the compressed air is subsequently supplied from the airtight cell via the communicating path to the airtight cells not having a port until all the airtight cells are inflated.

The communicating path may be provided with a flow course retaining member. The flow course retaining member comprises a copiously porous retaining piece or a meshed retaining piece inserted in the communicating path so as to ensure constant flow of air through the communicating path.

The flow course retaining member is produced by forming a plurality of punching holes in a thin sheet, which may be formed of soft urethane resin. This thin sheet may be inserted in the communicating path.

The communicating path is formed by imparting a state devoid of airtightness to part of the sealed portion of a relevant airtight cell. The communicating path is adapted to permit the supply of compressed air sequentially through the airtight cells from the airtight cell on the peripheral side onward and enable the airtight cells to be inflated sequentially in the direction from the peripheral to the central side.

Further, the communicating path has its width and length properly set so as to confer necessary deviation upon the times to start inflating the airtight cells, with the result that the circulation of blood is promoted and the effect of massaging is further exalted.

This invention is also directed to a compressing device for a pneumatic massager comprising a bag body formed of a plurality of airtight cells and adapted to inflate and contract the airtight cells by supplying and discharging compressed air to and from the bag body and characterized by forming a notch at a suitable position of the bag body such that when the bag body is attached to a leg or an arm, the knee portion or the elbow portion will be exposed to sight. Even after the user has set this bag body on his person, he can easily bend or stretch the knee or the elbow.

Further this invention is directed to a compressing device for a pneumatic massager, comprising a bag body formed of a plurality of airtight cells and provided with communicating paths differing in cross-sectional area, length and shape, and allowing communication between the adjacent airtight cells and characterized by sequentially inflating and contracting the airtight cells by supplying compressed air through an airtight cell on the peripheral side and discharging the compressed air through an airtight cell on the central side. When a compressed air supply source is made to communicate with the airtight cell on the peripheral side, and operated to supply compressed air to the particular airtight cell, the compressed air is dispensed and supplied first to the particular airtight cell and sequentially through the rest of airtight cells in the direction toward the central portion of the body through the communicating paths and the airtight cells are sequentially inflated in the direction from the peripheral to the central portion of the body. When the compressed air is discharged from the airtight cell on the central side, the airtight cells are sequentially contracted in the direction to the peripheral side from this particular airtight cell onward. The massage aimed at is effected by inflating and contracting the airtight cells in the manner described above. The massaging effect can be improved by adjusting the lag between the time to start inflating and contracting the airtight cells on the upstream side and the time to start inflating and contracting the airtight cells on the downstream side through the cross-sectional areas, lengths and shapes of the communicating paths.

Then, by causing the cross-sectional areas of the communicating paths on the peripheral side to be larger than those of the communicating paths on the central side, the addition to the inflation of the airtight cells on the peripheral side is enlarged and the massaging effect further improved when the compressed air is supplied from the peripheral side. Further, by forming the communicating paths by imparting a state devoid of airtightness to part of the sealed portions separating the adjacent airtight cells, the cost of the compressing device is lowered.

By providing the airtight cell on the peripheral side with a supply port for supplying compressed air and providing the airtight cell on the central side with a discharge port for discharging the compressed air, part of the compressed air supplied to the airtight cell on the peripheral side is supplied sequentially to the other airtight cells on the central side to inflate the airtight cells sequentially in the direction from the peripheral to the central portion of the body and, at the same time, the compressed air is discharged smoothly from the airtight cell on the central side onward to contract the airtight cells sequentially in the direction from the central to the peripheral portion of the body, with the result that the blood liable to stagnate in the periphery will be circulated perfectly and the massage will be effected with high efficiency.

DESCRIPTION OF THE PREFERRED EMBODIMENTS OF THE INVENTION

Preferred embodiments of the compressing device for a pneumatic massager according to this invention will be described below with reference to the accompanying diagrams.

Figure 3:
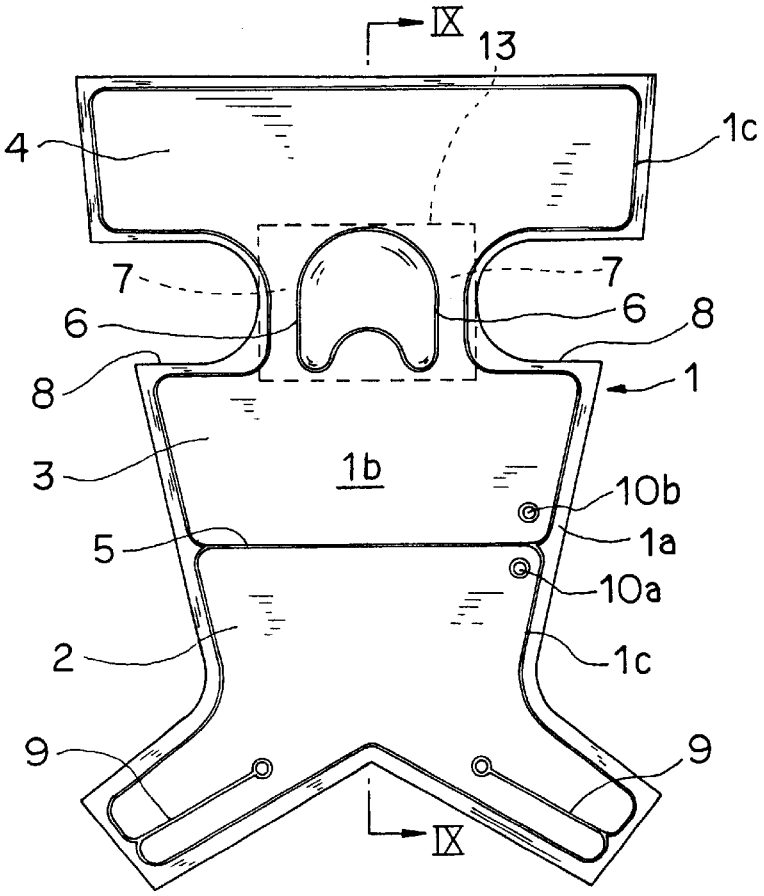
FIG. 3 is an expanded view illustrating one example of the compressing device.
Figure 9:
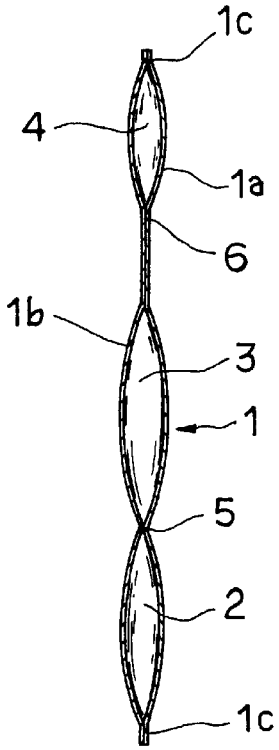
FIG. 9 is a magnified cross section taken through FIG. 3 along the line IX—IX.

A bag body 1 is produced by forming an outer air-impervious resin sheet 1*a* of small elasticity and an inner air-impervious resin sheet 1*b* of large elasticity in such a shape as illustrated in FIG. 3 and FIG. 9 and fusing the matched peripheries as by a high-frequency heating means.

As the raw material for these sheets 1*a* and 1*b*, a synthetic resin such as urethane resin or polyvinyl chloride resin is used.

Figure 1:
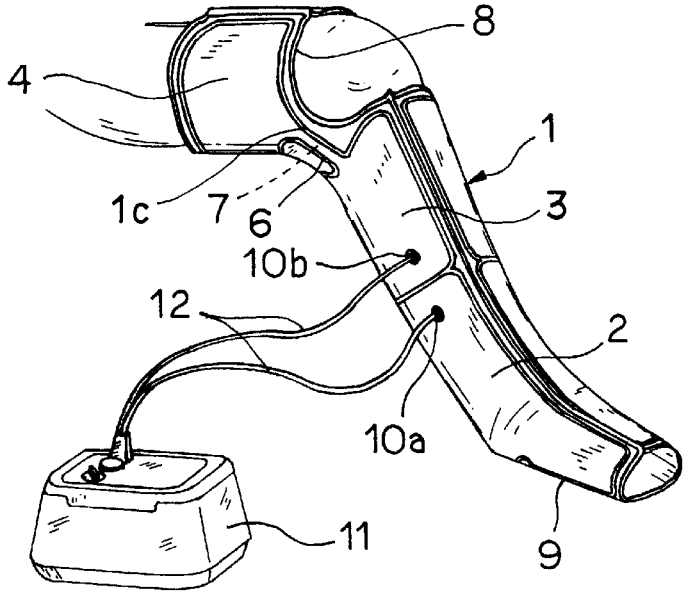
FIG. 1 is a perspective view illustrating one preferred embodiment of a compressing device for a pneumatic massager according to this invention in a state of use.
Figure 2:
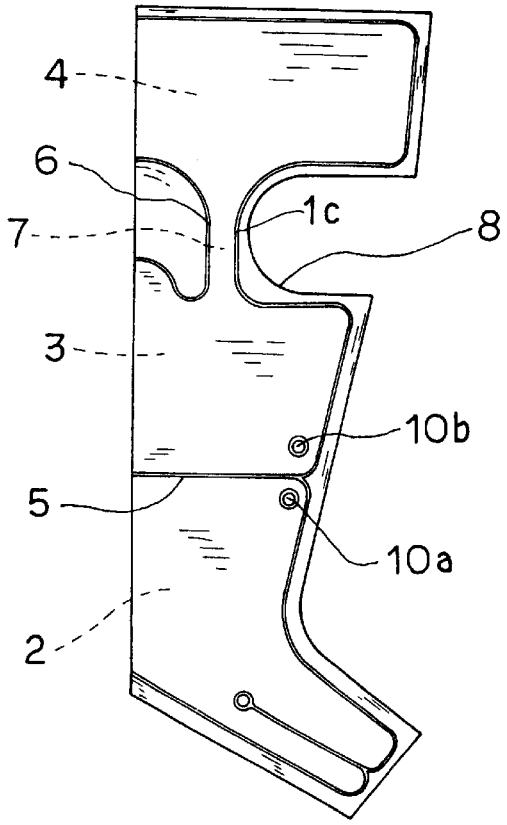
FIG. 2 is a plan view of the compressing device of FIG. 1.

Two sheet members formed roughly in the shape of a leg and containing notches 8 in the approximate shape of the letter U at the knee position as illustrated in FIGS. 1 through 3 are superposed, and the matched peripheries of the sheet members are fused at 1*c* by the use of a high-frequency heating means, for example, to obtain one bag body 1. The sheet members are then fused in a short width direction to form a sealed portion 5 that divides and seals part of this bag body extending from the terminal edge to the lower edges of the notches 8 into two parts and gives rise to airtight cells 2 and 3 of the shape of a flat bag.

The bag body 1 is further provided in a partitioning area of the airtight cell 3 and an airtight cell 4, with a second sealed portion 6 of a prescribed length. The sealed portion 6 and the fused portion 1*c* jointly form communicating paths 7.

These communicating paths 7 have their widths and lengths formed at suitable distances so as to impart a lag to the times at which the airtight cell 3 and the airtight cell 4 start inflating and contracting.

The bag body 1 has formed therein a combination of the notches 8 for exposing the user's knee or elbow when it is set on the leg or the arm.

The bag body 1 is further provided with a sealed partition portion 9 for defining the upper part of the foot and the sole part of the foot in the foot area. The airtight cell 2 and the airtight cell 3 are provided with ports 10*a* and 10*b*, respectively, destined to serve as supply and discharge openings for compressed air. Air hoses 12 connected to a compressed air supply source 11 such as a compressor are connected to the ports 10*a* and 10*b*.

Figure 4:
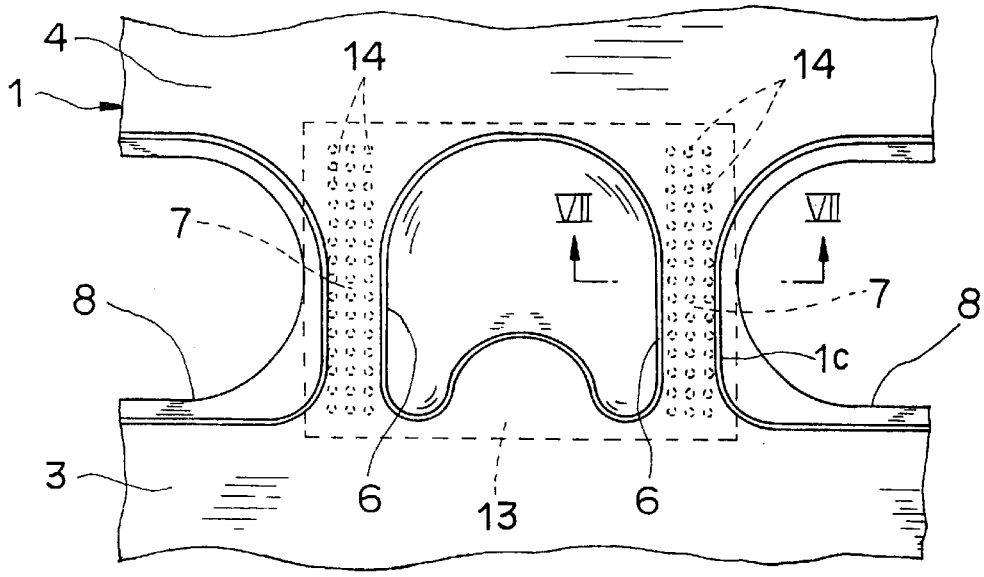
FIG. 4 is a partially magnified view of FIG. 3.
Figure 7:
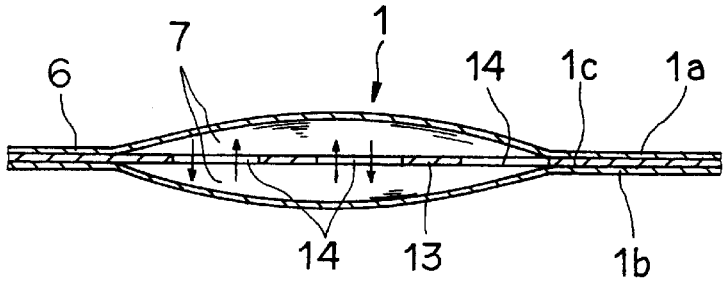
FIG. 7 is a magnified cross section taken through FIG. 4 along the line VII—VII.

The reference numeral 13 shown in FIG. 3 and FIG. 4 denotes a retaining piece intended as a flow course retaining member for the communicating path 7. As shown in FIG. 4, this retaining piece 13 is provided with a plurality of punched holes serving as ventilating holes 14. This retaining piece 13 is formed of thin sheet material (about 0.2 mm in the present case) of soft urethane resin. During the fusion of the sheets 1*a* and 1*b*, this retaining piece 13 is interposed in a tacked state. It is eventually interposed and superposed at the position of the communicating path 7 as illustrated in FIG. 7.

The ventilating holes 14 formed in the retaining piece 13 are formed in one equal diameter and arrayed as illustrated in FIG. 4. They do not need to be limited to this arrangement.

Figure 5:
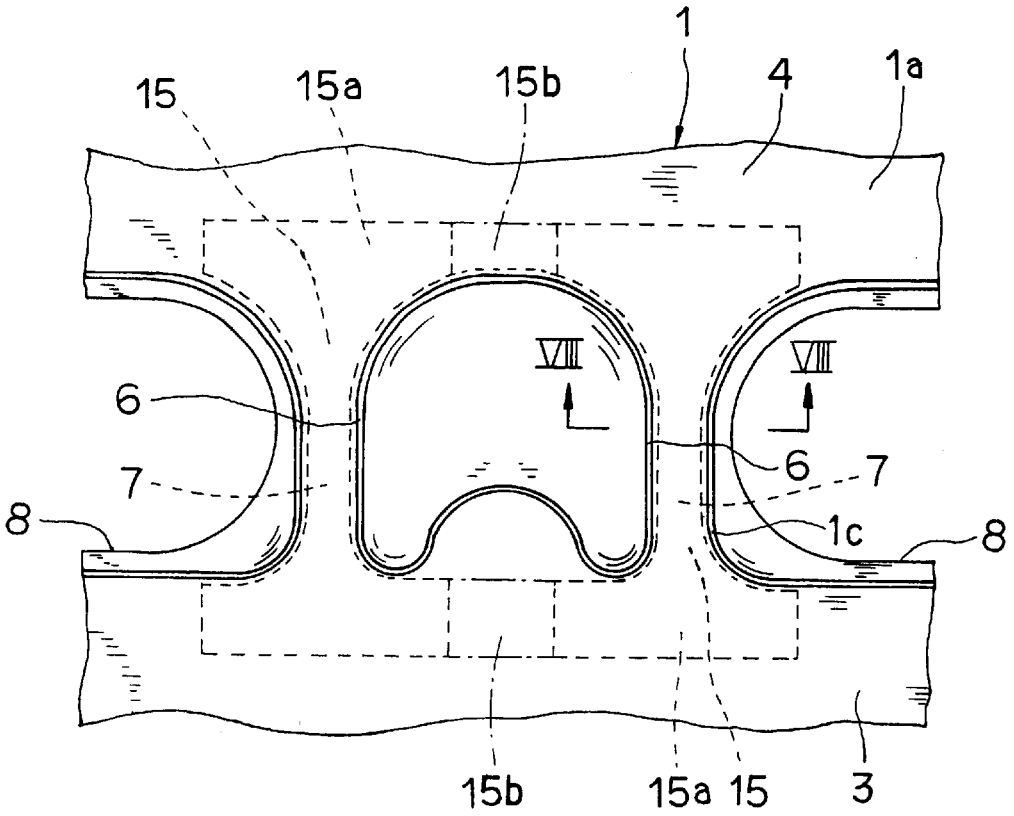
FIG. 5 is a partially magnified view illustrating another example of the compressing device.
Figure 6:
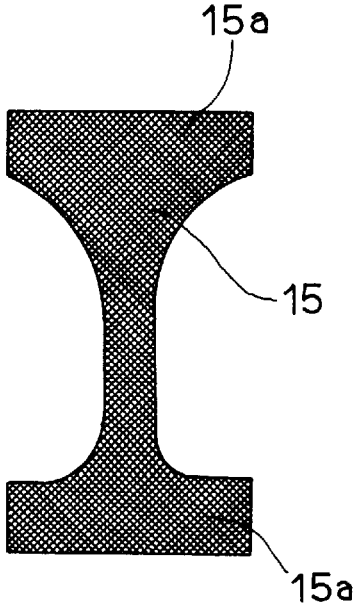
FIG. 6 is a plan view illustrating a retaining piece shown in FIG. 5.

The reference numeral 15 shown in FIG. 5 and FIG. 6 denotes a flow course retaining member as another embodiment of the communicating path 7. This flow course retaining member 15 is a meshed retaining piece of thin sheet formed of soft synthetic resin. This retaining piece 15 is provided at the opposite ends thereof with engaging projections 15*a* and interposed in, tacked on and attached to the communicating path 7 prior to the fusion of the sheets 1*a* and 1*b*.

Figure 8:
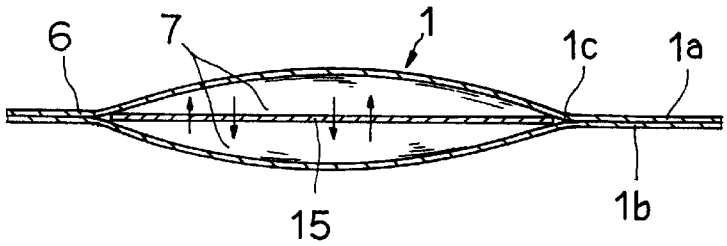
FIG. 8 is a magnified cross section taken through FIG. 5 along the line VIII—VIII.

Two retaining pieces 15 may be interposed between the sheets 1*a* and 1*b* respectively at two communicating paths 7 or may be interposed between the sheets 1*a* and 1*b* as joined to each other with connecting pieces 15*b* and 15*b* into one integral retaining piece as illustrated in FIG. 5 and FIG. 8. The mesh does not need to be limited to what is illustrated in FIG. 6.

Thus, the retaining piece may have perforations in the form of mesh material or have a plurality of holes. The perforated retaining pieces 13 and 15 are preferred to have a thickness sufficient to avoid inflicting a feeling of uncomfortableness on the skin of the user being massaged.

This bag body 1 is doubled up as illustrated in FIG. 2 and the matched edges are fused or sewn in the direction of length to complete an approximately cylindrical boot shaped like a leg. Optionally, the bag body 1 may be provided along the opposite edges in the direction of width of the developed bag body of FIG. 3 with fasteners which are utilized for attaching the bag body fast to the leg during the attachment.

The communicating paths 7 are formed in suitable widths and lengths such that the times to start inflating the airtight cells 3 and 4 will deviate properly. This deviation of the times to start inflating the airtight cells 3 and 4 is essential for increasing the massaging effect. Actually, the widths and lengths are so selected as to ensure manifestation of the massaging effect to the best advantage.

Incidentally, the present embodiment is provided with three airtight cells 2, 3 and 4 as illustrated in FIGS. 2 and 3. For the invention, this number is not critical. The sheet members, though not illustrated, may be formed in a shape fit for the body portion to be massaged, specifically in such a shape that the bag body will assume the approximate shape of an arm, for example. Again in this case, the notch capable of exposing the elbow part may be properly formed.

Now, the operation of the embodiment described above will be explained below.

In preparation for use, the bag body 1 of the compressing device for a massager is attached to the leg as though a boot is put on as illustrated in FIG. 1 and the air hose 12, connected on one side to the compressed air supply source 11 such as a compressor, is connected on the other side to the port 10*a*. At this time, the notch 8 formed in the bag body 1 of the compressing device exposes the knee. The bag body 1 of this compressing device, though not illustrated, may be attached to each of the legs to be massaged.

When the compressed air supply source 11 is set to operate, the compressed air is supplied from the compressed air supply source 11 first to the airtight cell 2 via the air hose 12 to start inflating the airtight cell 2. After the inner pressure of this airtight cell 2 has reached the upper limit, the pressure inside the airtight cell 2 is retained for a prescribed length of time.

After the elapse of a prescribed length of time following the arrival of the inner pressure of the airtight cell 2 at the upper limit and while the inner pressure of the airtight cell 2 is still being retained, the compressed air emanating from the compressed air supply source 11 is supplied via the air hose 12 to the airtight cell 3 to start inflating the airtight cell 3. While the inner pressure of this airtight cell 3 is in the course of reaching the upper limit, part of the compressed air already supplied to the interior of the airtight cell 3 is supplied via the communicating paths 7 to the airtight cell 4 to start inflating the airtight cell 4 with a lag from the airtight cell 3.

In this case, since the communicating paths 7 are provided with the flow course retaining member 13 or 15, the compressed air in the communicating paths 7 is enabled by the retaining piece 13 provided with a multiplicity of ventilating holes 14 (FIG. 4) or the retaining piece 15 provided with a reticular texture (FIG. 6) to pass freely between the obverse side and the reverse side of the retaining piece 13 or 15 as indicated by arrow marks in FIG. 7 and FIG. 8 and expand the communicating paths 7 and secure ample flow for air. Thus, the possibility of the communicating paths 7 being bent to obstruct the flow is totally nil.

Then, after the retention of the inner pressure of the airtight cell 2 has lasted for a prescribed length of time following the start of inflation of the airtight cells 3 and 4, the compressed air in the airtight cell 2 is discharged via the air hose 12 and the airtight cell 2 begins to contract. At this time, the inner pressure of the airtight cell 3 has reached the upper limit and begun to remain at this upper limit, and the inner pressure of the airtight cell 4 is in the course of reaching the upper limit.

Then, inner pressure of airtight cell 2 reaches the atmospheric pressure to terminate the contraction of the airtight cell 2. Meanwhile, the inner pressure of the airtight cell 4 reaches the upper limit with a lag from the airtight cell 3. As a result, the airtight cells 3 and 4 both are allowed to retain their inner pressure intact. The blood stagnating at the terminal periphery (i.e., peripheral portions of the appendages) can be circulated back to the central portion of the body because time lags occur among the times at which the airtight cells 2, 3 and 4 begin to inflate.

While the airtight cells 3 and 4 are retaining their inner pressure and after the elapse of a prescribed length of time following the start of supply of compressed air to the airtight cell 2 in the preceding cycle, the compressed air supply source 11 again supplies the compressed air via the air hose 12 to the airtight cell 2 to start inflating the airtight cell 2 again. After the start of this inflation of the airtight cell 2 and after the elapse of a prescribed length of time following the arrival of the inner pressure of the airtight cell 4 at the upper limit, the compressed air flows into the airtight cell 3 through the communicating paths 7 and then reaches the ambient air through the airtight cell 3 via the air hose 12. Consequently, the airtight cell 3 begins contracting and, with a lag therefrom, the airtight cell 4 begins contracting. Then, the airtight cells 3 and 4 complete contraction after the inner pressure of the airtight cell 2 has reached the upper limit and meanwhile the inner pressures of the airtight cells 3 and 4 have reached the atmospheric pressure substantially simultaneously.

In this case, since the communicating paths 7 are provided with the flow course retaining member 13 or 15, the air is freely passed between the obverse side and the reverse side of the flow course retaining member 13 or 15 even when the communicating paths 7 are bent. The air is then enabled to expand the communicating paths 7 to secure a flow course for air and permit the air to be discharged from the airtight cell 4 to the airtight cell 3.

Thereafter, the process which comprises termination of the inflation of the airtight cell 2, start of the inflation of the airtight cell 3, and start of the inflation of the airtight cell 4 is repeated to inflate and contract the airtight cells 2, 3 and 4 sequentially in the order mentioned. Thus, the massage for promoting blood circulation is carried out efficiently.

For the purpose of simultaneously supplying the compressed air to the airtight cells 2 and 3, necessary time lags preceding the start of inflation can be adjusted by suitably varying the inner volumes of the airtight cells 2 and 3.

Though the embodiment, as illustrated above, has the ventilating holes 14 provided in the retaining piece 13 of the flow course retaining member, one or both sides of the retaining piece 13 may be provided with protuberances capable of forming gaps sufficient to preclude tight adhesion between the retaining piece 13 and the resin sheets 1*a* and 1*b* instead of being provided with the ventilating holes 14.

Figure 10:
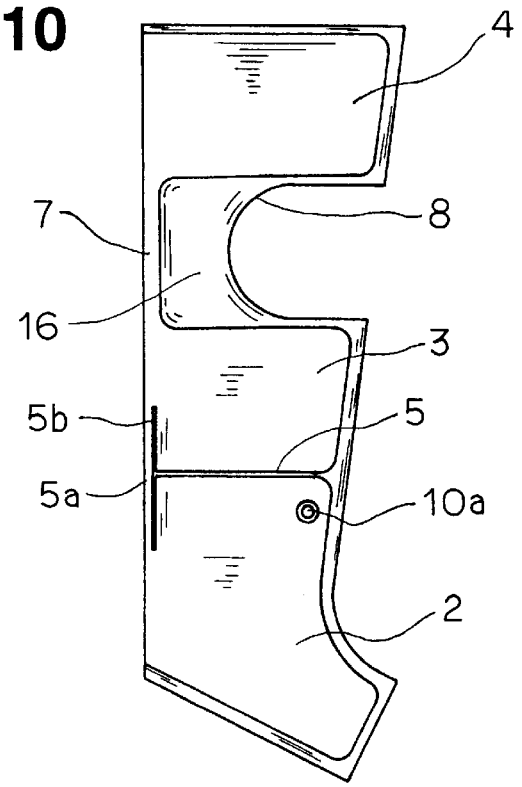
FIG. 10 is a plan view illustrating another preferred embodiment of a compressing device for a pneumatic massager according to this invention.
Figure 13:
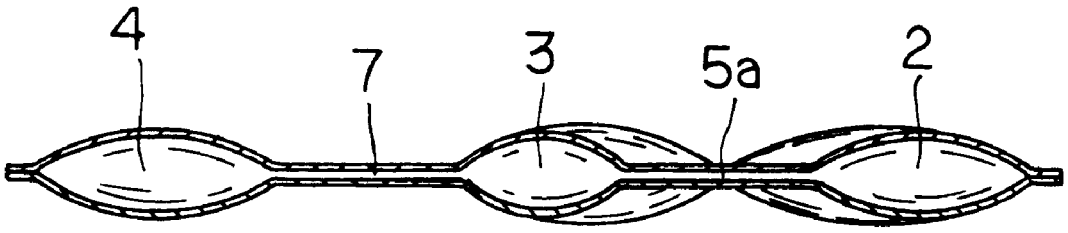
FIG. 13 is a cross section taken through FIG. 11 along the line XIII—XIII.

FIG. 10 and FIG. 13 represent compressing devices for a pneumatic massager, depicting other embodiments of this invention. In these diagrams, like component parts found in the preceding embodiment are denoted by like reference numerals.

Figure 11:
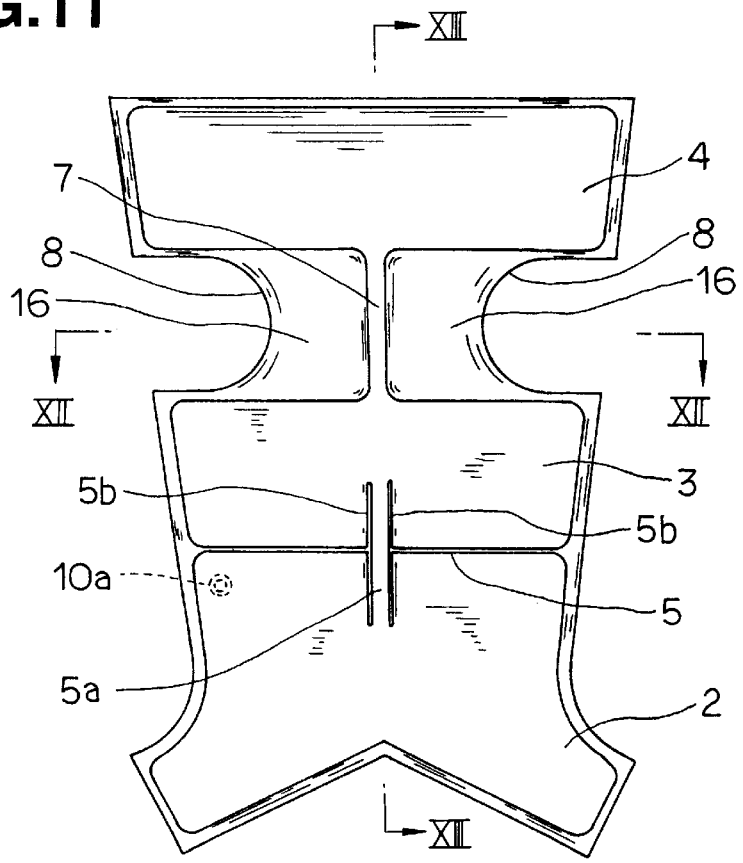
FIG. 11 is an expanded view of the compressing device of FIG. 10.
Figure 12:
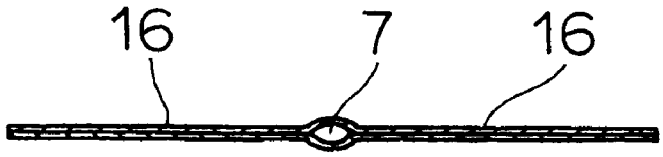
FIG. 12 is a magnified terminal cross section taken through FIG. 11 along the line XII—XII.

Though the first illustrated embodiment forms the sealed portion 5 in an airtight state and provides the airtight cells 2 and 3 respectively with the ports 10*a* and 10*b* each destined to serve as an opening for supplying and discharging the compressed air, the embodiment shown in FIG. 10 contemplates forming two parallel fused lines 5*b* as extended from the substantially central part of the sealed portion 5 separating the airtight cells 2 and 3 toward the interiors of the airtight cells 2 and 3, thereby imparting a state devoid of airtightness to the substantially central part of the sealed portion 5 and giving rise to a slender communicating path 5*a* for allowing communication between the airtight cells 2 and 3. Further, as illustrated in FIG. 11, the area intervening between the notches 8 is fused to form a second sealed portion 16 to give rise to the airtight cell 4 shaped like a flat bag on the central side from the notches 8 and, at the same time, the substantial center of the second sealed portion 16 is formed in a state devoid of airtightness and allowed to form a slender communicating path 7 for allowing communication between the airtight cells 3 and 4.

The communicating paths 5*a* and 7 are formed in suitable widths and lengths so as to impart proper lags among the times at which the airtight cells 2, 3 and 4 begin to inflate. Particularly, the lags among the times for starting inflation of the airtight cells 2, 3 and 4 are essential for the purpose of improving the massaging effect. Actually, the widths and lengths are so selected as to ensure manifestation of the massaging effect to the best advantage. In a bag body which, as illustrated in FIG. 11, has an overall length of about 860 mm and an overall width of about 650 mm and has the ratio of sizes of the airtight cells 2, 3 and 4 in the direction of length set at about 35:20:18, for example, the communicating paths 5*a* and 7 are preferred to measure 20–30 mm in width and 130 mm in length.

When the compressed air supply source 11 is set operating, the compressed air is supplied first into the airtight cell 2 having the air hose 12 connected thereto to start inflating the airtight cell 2. While the inner pressure of the airtight cell 2 is in the process of reaching the upper limit, part of the compressed air already supplied to the airtight cell 2 is passed through the communicating path 5*a* in the airtight cell 3 to start inflating the airtight cell 3. Further, while the inner pressure of the airtight cell 3 is in the course of reaching the upper limit, part of the compressed air already supplied to the airtight cell 3 is passed through the communicating path 7 in the airtight cell 4 to start inflating the airtight cell 4, with the result that first the inner pressure of the airtight cell 2 will reach the upper limit, then the inner pressure of the airtight cell 3 will reach the upper limit, and finally the inner pressure of the airtight cell 4 will reach the upper limit to cause sequential inflation of the airtight cells 2, 3 and 4 in the order mentioned. The blood stagnating at the terminal periphery can be circulated back to the central portion of the body because time lags occur among the times at which the airtight cells 2, 3 and 4 begin to inflate.

After the inner pressures of the airtight cells 2, 3 and 4 have retained their upper limits for prescribed lengths of time, the compressed air supply source 11 assumes an evacuated state and the compressed air in the airtight cell 2 is discharged via the air hose 12, with the result that first the airtight cell 2 will begin contraction, the airtight cell 3 will begin to contract with a lag therefrom, and the airtight cell 4 will begin to contract with a further lag therefrom. All the airtight cells 2, 3 and 4 terminate their contraction after the inner pressures of the airtight cells 2, 3 and 4 have reached the atmospheric pressure substantially at the same time. Thereafter, the process mentioned above is repeated to repeat the sequential inflation and contraction of the airtight cells 2, 3 and 4 in the order mentioned. Thus, the massage for promoting the blood circulation is carried out efficiently.

Figure 14:
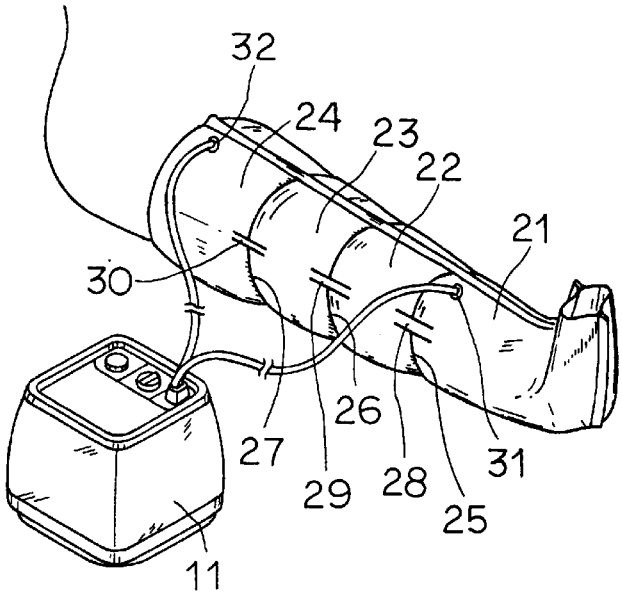
FIG. 14 is a schematic perspective view illustrating a state of use of still another preferred embodiment of a compressing device for a pneumatic massager according to this invention.
Figure 15:
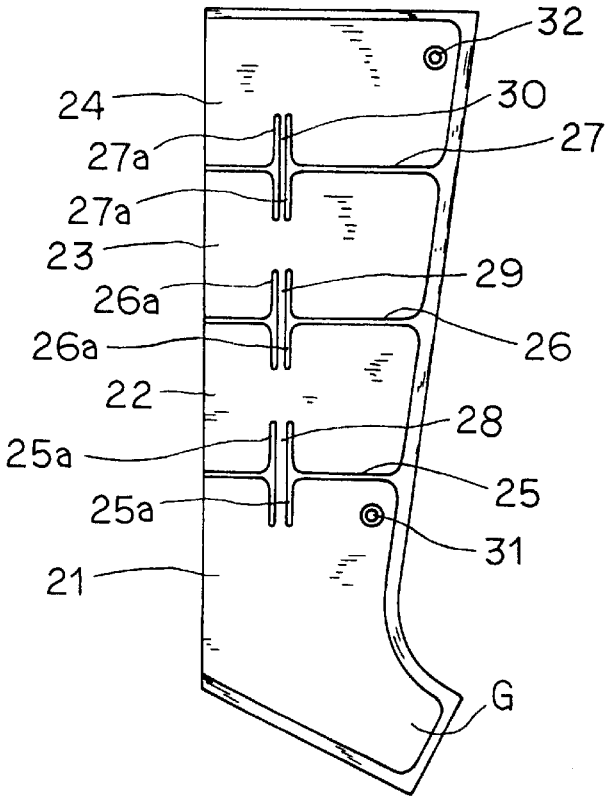
FIG. 15 is a plan view illustrating the compressing device of FIG. 14.

FIG. 14 is a schematic perspective view illustrating yet another embodiment of this invention.

One flat bag body is produced by superposing two sheet members F and G formed in the shape of a leg in an expanded state and fusing the matched edges by the use of a high-frequency heating means, for example. Further, linear sealed portions 25, 26 and 27 are formed by fusing the sheet members F and G in the direction of the shorter distance. These sealed portions 25, 26 and 27 divide the interior of the bag body into four sections and give rise to airtight cells 21, 22, 23 and 24, each of the shape a flat bag.

In the sealed portions 25, 26 and 27, communicating paths 28, 29 and 30, each the shape of a flat cylinder, are adapted to allow communication between the adjacent airtight cells 21 and 22, 22 and 23, and 23 and 24 are formed.

These communicating paths 28, 29 and 30 are formed of sealed parts 25*a*, 26*a* and 27*a* which have been formed by imparting a state devoid of airtightness to parts of the sealed portions 25, 26 and 27 and fusing the sheet members F and G in the opposite directions in the direction of length extending from the end at which the state of airtightness terminates. Further, they are so formed that their opening cross sections decrease from the communicating path 28 on the peripheral portion of the body to the communicating path 29 on the intermediate portion and further to the communicating path 30 on the central-most portion of the appendage. Thus, proper lags are allowed to occur among the times to start the inflation of the airtight cells 21, 22, 23 and 24 because the entrances to the communicating paths 28, 29 and 30 are respectively thrust into the airtight cells 21, 22 and 23 and the opening cross sections of the communicating paths 28, 29 and 30 are caused to decrease gradually from the peripheral to the central side.

Figure 16:
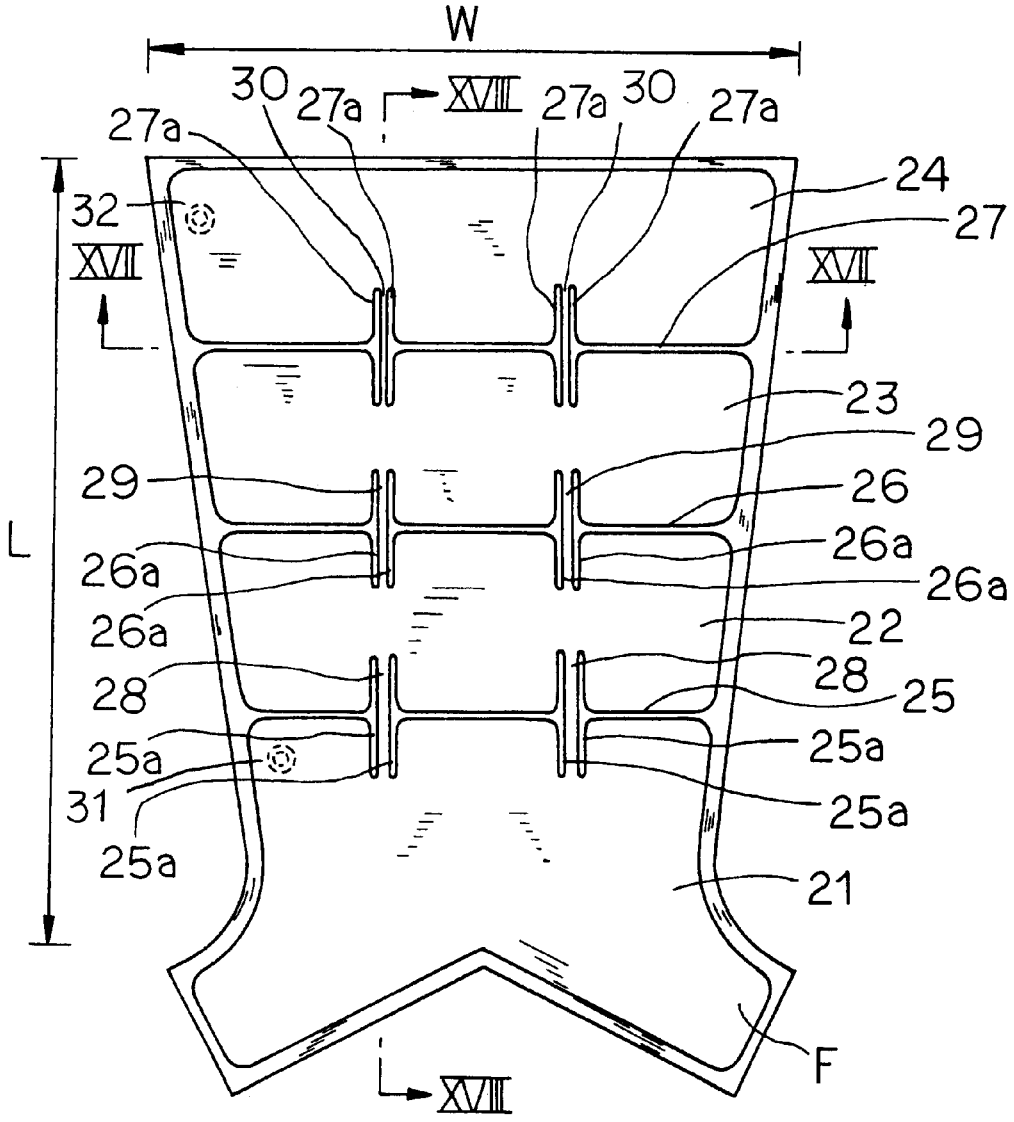
FIG. 16 is a plan view illustrating the compressing device of FIG. 15 in a developed state.
Figure 17:
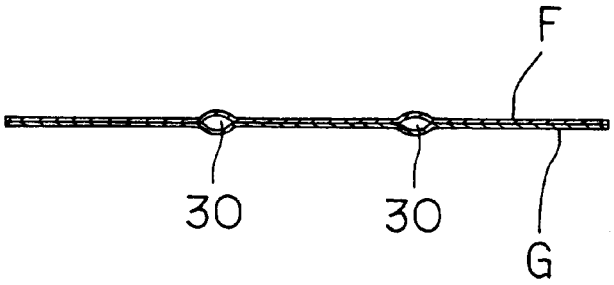
FIG. 17 is a terminal cross section taken through FIG. 16 along the line XVII—XVII.
Figure 18:
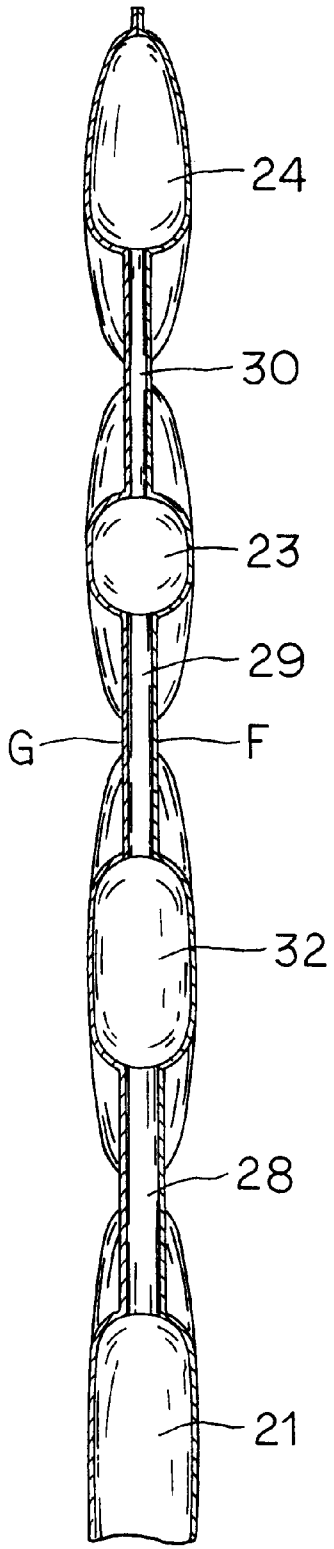
FIG. 18 is a magnified partial cross section taken through FIG. 16 along the line XVIII—XVIII.

A compressing device which, as illustrated in FIG. 16, has a length L of about 750 mm and a width W of about 600 mm, for example, is preferred to have all the lengths of the communicating paths 28, 29 and 30 set at 130 mm, the width of the communicating path 28 at 30 mm, the width of the communicating path 29 at 25 mm, and the width of the communicating path 30 at 20 mm.

While the communicating paths 28, 29 and 30, as illustrated above, are respectively formed with two parallel sealed parts 25*a*, 26*a* and 27*a*, the sealed parts 25*a*, 26*a* and 27*a* may be slanted in a pattern converging toward the central side or part of the sealed portions 25, 26 and 27 may be provided with a hole formed in a state devoid of airtightness or with a tube interconnecting the adjacent airtight cells 21 and 22, 22 and 23, and 23 and 24. When the tubes are elected, they are varied in diameter and length so as to produce proper lags among the times to start the inflation of the airtight cells 21, 22, 23 and 24.

The airtight cell 21 is provided with a supply port 31 for supplying compressed air and the airtight cell 24 is provided with a discharge port 32 for discharging the compressed air. The airtight cell 21, when necessary, may be made to take sole charge of supplying and discharging the compressed air by providing it with a supply-and-discharge opening.

Though the present embodiment, as illustrated in FIG. 16, is provided with four airtight cells 21, 22, 23 and 24, this number is not critical. The sheet members F and G, though not illustrated, may be formed in a shape fit for the body portion to be massaged, specifically in such a shape that they will assume the approximate shape of an arm, for example. It is also permissible to form notches for exposing the knee or the elbow at suitable positions so as to allow the joints to be easily bent or stretched.

The concept of gradually decreasing the opening cross sections of the communicating paths and adjusting the lags among the times for starting the inflation of the airtight cells can be applied not only to the compressing device for a pneumatic massager but also to a pneumatic mattress intended to prevent a patient from suffering a bedsore.

The invention described in detail above allows provision of an inexpensive compressing device for a pneumatic massager which is prepared easily for use because it permits a decrease in the number of inlets and outlets and air hoses which are used for connecting the compressed air supply source and the airtight cells and which, therefore, have been heretofore used in the same numbers as the airtight cells and, at the same time, permits a decrease in the amount of work for connecting the airtight cells to the compressed air supply source. It further allows provision of an inexpensive pneumatic massager capable of efficient massage because the airtight cells can be inflated sequentially in the direction from the peripheral to the central side without necessitating use of a distributing device of complicated structure.

Since the times to start inflating the airtight cells are caused to deviate, the blood circulation can be efficiently promoted by applying pressure sequentially in the direction from the peripheral to the central side of the leg or the arm. Thus, the massaging effect can be further increased.

The flow course retaining members interposed in the communicating paths of the bag body prevent the flow courses from being blocked even when the communicating paths are bent during the use of the massager and consequently secure ample flow for the compressed air in the communicating paths. Thus, the effective massage is attained by sequentially supplying the compressed air from the airtight cell on the peripheral side onward and consequently enabling the airtight cells to be sequentially inflated and contracted from the peripheral to the central portion of the body.

Further, by adjusting the timing of inflation and contraction, it is made possible to inflate and contract the airtight cells sequentially along the venous stream and produce a highly effective massage with better pressure sensation. By discriminating between the airtight cells for supplying the compressed air and the airtight cells for discharging the compressed and enabling the compressed air to be supplied through the airtight cells on the peripheral side and discharged through the airtight cells on the central side, the inflation and contraction can be carried out smoothly even when there are provided a plurality of communicating paths.

What is claimed is:

1. A compressing device for a pneumatic massager, comprising:

a bag body formed of a plurality of airtight cells, said airtight cells having sealed portions separating said airtight cells from each other;

at least one port for supplying and discharging compressed air to said airtight cells, said at least one port being provided with at least one of said airtight cells and such that said airtight cells include at least one airtight cell without said at least one port;

at least one communicating path fluidly communicating said at least one airtight cell without said at least one port with said at least one of said airtight cells provided with said at least one port; and a thin, flat, and flexible flow course retaining sheet member provided in said at least one communicating path, said flow course retaining sheet member having a plurality of perforations;

whereby the supply and discharge of compressed air to and from said bag body through said at least one port will inflate and contract said airtight cells.

2. The compressing device of claim 1, wherein said flow course retaining sheet member comprises a thin mesh of soft synthetic resin in said at least one communicating path.

3. The compressing device of claim 1, wherein said flow course retaining sheet member comprises a thin sheet of soft synthetic resin having a plurality of punched holes therein and being located in said at least one communicating path.

4. The compressing device of claim 1, wherein said at least one communicating path comprises an unsealed part of said sealed portions.

5. The compressing device of claim 4, wherein said bag body is formed by an outer sheet and an inner sheet that define said airtight cells therebetween, said sealed portions comprising portions at which said outer sheet is connected with said inner sheet, and wherein said unsealed part of said sealed portions comprises a portion along said sealed portions at which said outer sheet is not connected to said inner sheet located between two of said airtight cells.

6. The compressing device of claim 5, wherein said unsealed part is defined between lines along which said outer sheet and said inner sheet are fused with each other, said lines extending into said two of said airtight cells.

7. The compressing device of claim 1, wherein said communicating path has a length and width such that when air is supplied into said at least one of said airtight cells provided with said at least one port to inflate said at least one of said airtight cells provided with said at least one port to inflate, said at least one airtight cell without said at least one port begins to inflate due to air supplied through said communicating path with a time lag.

8. The compressing device of claim 2, wherein said communicating path has a length and width such that when air is supplied into said at least one of said airtight cells provided with said at least one port to inflate said at least one of said airtight cells provided with said at least one port to inflate, said at least one airtight cell without said at least one port begins to inflate due to air supplied through said communicating path with a time lag.

9. The compressing device of claim 3, wherein said communicating path has a length and width such that when air is supplied into said at least one of said airtight cells provided with said at least one port to inflate said at least one of said airtight cells provided with said at least one port to inflate, said at least one airtight cell without said at least one port begins to inflate due to air supplied through said communicating path with a time lag.

10. A compressing device for a pneumatic massager, comprising:

a bag body formed of a plurality of airtight cells, said airtight cells having sealed portions separating said airtight cells from each other, and said bag body being adapted to inflate and contract said airtight cells through the supply and discharge of compressed air to and from said bag body, wherein said bag body has a shape corresponding to one of a leg and an arm such that said bag body can be attached to the one of the leg and the arm in a fitting position in which said bag body extends on opposite sides of the respective one of the knee and the elbow;

a notch provided in said bag body at a location corresponding to the respective one of the knee and the elbow such that when said bag body is in said fitting position on the one of the leg and the arm, said notch is located at the respective one of the knee and the elbow so that the respective one of the knee and the elbow is uncovered by said bag body;

at least one communicating path located at said notch so as to connect at least one of said airtight cells located above said notch and at least one of said airtight cells located below said notch; and a thin, flat, and flexible flow course retaining sheet member provided in said at least one communicating path, said flow course retaining sheet member having a plurality of perforations.

11. A compressing device for a pneumatic massager, comprising:

a bag body formed of a plurality of airtight cells, said airtight cells having sealed portions separating said airtight cells from each other, said bag body having a peripheral end to be located closest to a peripheral portion of a body and a central end to be located closest to a central portion of the body, and said airtight cells including a peripheral end airtight cell and a central end airtight cell;

a supply port in said peripheral end airtight cell for supplying compressed air;

a discharge port in said central end airtight cell for discharging compressed air;

a plurality of communicating paths that differ from each other in at least one of cross-sectional area of opening, length and shape, each of said plurality of communicating paths fluidly communicating adjacent ones of said airtight cells, whereby the supply of compressed air to said supply port and discharge of air from said discharge port causes sequential inflation and contraction of said airtight cells; and a thin, flat, and flexible flow course retaining sheet member provided in at least one of said communicating paths, said flow course retaining sheet member having a plurality of perforations.

12. The compressing device of claim 11, wherein one of said plurality of communicating paths that fluidly communicates with said peripheral end airtight cell has a cross sectional area of opening that is larger than that of another one of said plurality of communicating paths that fluidly communicates with said central end airtight cell.

13. The compressing device of claim 11, wherein said communicating paths comprises unsealed parts of said sealed portions.

14. The compressing device of claim 12, wherein said communicating paths comprises unsealed parts of said sealed portions.

* * * * *